US010196777B2

(12) United States Patent
Umehara et al.

(10) Patent No.: US 10,196,777 B2
(45) Date of Patent: Feb. 5, 2019

(54) SHOE PRESS BELT AND METHOD OF MANUFACTURING THE SAME

(71) Applicant: Ichikawa Co., Ltd., Bunkyo-ku (JP)

(72) Inventors: Chie Umehara, Tokyo (JP); Shintaro Yamazaki, Tokyo (JP); Yuya Takamori, Tokyo (JP)

(73) Assignee: ICHIKAWA CO., LTD., Bunkyo-ku (JP)

( * ) Notice: Subject to any disclaimer, the term of this patent is extended or adjusted under 35 U.S.C. 154(b) by 0 days.

(21) Appl. No.: 14/990,362

(22) Filed: Jan. 7, 2016

(65) Prior Publication Data

US 2016/0208437 A1 Jul. 21, 2016

(30) Foreign Application Priority Data

Jan. 16, 2015 (JP) ..... 2015-018827

(51) Int. Cl.
*D21F 3/00* (2006.01)
*D21F 1/00* (2006.01)
*D21F 3/02* (2006.01)

(52) U.S. Cl.
CPC ..... *D21F 1/0036* (2013.01); *D21F 3/0227* (2013.01); *D21F 3/0236* (2013.01)

(58) Field of Classification Search
CPC .... D21F 3/0227; D21F 3/0236; D21F 1/0036; Y10S 162/901; Y10S 162/90; Y10T 428/24355; Y10T 428/24942; Y10T 428/2457; Y10T 428/26; Y10T 442/20; Y10T 442/2344; Y10T 442/2098; Y10T 442/2066; Y10T 442/2041; Y10T 442/30; C08G 18/09; C08G 18/10
See application file for complete search history.

(56) References Cited

U.S. PATENT DOCUMENTS 7,922,869 B2 * 4/2011 Ishino ..... D21F 3/0227 162/358.4
7,943,013 B2 * 5/2011 Yazaki ..... C08G 18/10 162/358.1
7,947,154 B2 * 5/2011 Yazaki ..... C08G 18/10 162/358.4
7,955,475 B2 * 6/2011 Yazaki ..... D21F 3/0227 162/358.4

(Continued)

FOREIGN PATENT DOCUMENTS

CA 2917543 A1 * 7/2016 ..... D21F 1/0036
EP 1 338 696 A1 8/2003

(Continued)

*Primary Examiner* — Jose A Fortuna
(74) *Attorney, Agent, or Firm* — Oblon, McClelland, Maier & Neustadt, L.L.P.

(57) ABSTRACT

A shoe press belt with excellent mechanical properties, in particular excellent wear resistance is provided, and a method of manufacturing the shoe press belt for use in a papermaking machine is also provided. The belt is constituted by a resin layer and includes an outer circumferential layer surface contacting a felt. The outer circumferential layer surface is formed with a surface-treated layer, in which part of the resin layer is modified by coating a composition including an isocyanate compound onto a semi-finished outer circumferential layer and by performing a curing treatment.

1 Claim, 4 Drawing Sheets

(56) References Cited

U.S. PATENT DOCUMENTS 8,449,723 B2 * 5/2013 Yamazaki ..... D21F 3/0227 162/358.4
8,568,567 B2 * 10/2013 Hagfors ..... C08G 18/10 162/358.4
9,732,470 B2 * 8/2017 Yamazaki ..... D21F 3/0227
9,777,433 B2 * 10/2017 Takamori ..... D21F 3/029
2004/0029474 A1 2/2004 Watanabe et al.
2005/0139341 A1 * 6/2005 Watanabe ..... D21F 3/0227 162/358.4
2006/0118261 A1 * 6/2006 Ishino ..... D21F 3/0227 162/358.4
2009/0038770 A1 * 2/2009 Ishii ..... D21F 3/0227 162/358.4
2010/0059193 A1 * 3/2010 Ishino ..... D21F 3/0236 162/358.4
2010/0186920 A1 7/2010 Yazaki et al.
2010/0314065 A1 * 12/2010 Takamura ..... D21F 3/0227 162/358.2
2010/0314067 A1 * 12/2010 Yazaki ..... C08G 18/10 162/358.2
2011/0017419 A1 * 1/2011 Yazaki ..... D21F 3/0227 162/289
2011/0303383 A1 * 12/2011 Yamazaki ..... D21F 3/0227 162/358.4
2012/0012270 A1 * 1/2012 Inoue ..... D21F 3/0227 162/358.4
2012/0132384 A1 * 5/2012 Hagfors ..... C08G 18/10 162/358.2
2013/0192787 A1 * 8/2013 Yazaki ..... D21F 3/0227 162/358.4
2013/0192788 A1 * 8/2013 Yazaki ..... D21F 3/0227 162/358.4
2016/0130755 A1 * 5/2016 Yamazaki ..... D21F 3/0227 162/289
2016/0208437 A1 * 7/2016 Umehara ..... D21F 1/0036
2016/0355978 A1 * 12/2016 Takamori ..... D21F 3/029
2017/0218568 A1 * 8/2017 Takamori ..... D07B 3/103

FOREIGN PATENT DOCUMENTS

EP 1 985 750 A1 10/2008
EP 2248944 A1 * 11/2010 ..... C08G 18/10
EP 3 009 561 A1 4/2016
EP 3045586 A1 * 7/2016 ..... D21F 1/0036
JP 2002-146694 5/2002
JP 2008-111220 5/2008
JP 2008-536016 9/2008
JP 2009185427 A * 8/2009
JP 2012-511611 5/2012
JP 2013159860 A * 8/2013
WO WO 2006/113046 A1 10/2006
WO WO 2014/200095 A1 12/2014
WO WO 2014200095 A1 * 12/2014 ..... D21F 3/0227

* cited by examiner

SHOE PRESS BELT AND METHOD OF MANUFACTURING THE SAME

TECHNICAL FIELD

The present invention relates to a shoe press belt for use in a papermaking machine and a method of manufacturing the same.

DESCRIPTION OF THE RELATED ART

A papermaking machine for removing moisture from the source material of paper generally comprises a wire part, a press part and a dryer part. The wire part, the press part and the dryer part are arranged along the transfer direction of a wet paper web.

The wet paper web is dewatered and, at the same time, transferred while being passed between papermaking equipment provided in the wire part, press part and dryer part, respectively, to be finally dried in the dryer part. In each of these parts, papermaking equipment is used which corresponds to functions of dewatering the wet paper web (wire part), squeezing water from the wet paper web (press part), and drying the wet paper web (dryer part), respectively.

The press part is generally equipped with one or more press devices arranged in series in the wet paper web transfer direction. An endless felt, or an open-ended felt that has been formed into an endless felt by connecting it in the papermaking machine, is arranged in each press device. The press device is also equipped with a roll press mechanism comprising a pair of facing rolls or a shoe press mechanism, in which an endless shoe press belt is interposed between a roll and a shoe in concave shape facing said roll. By compressing the felt onto which the wet paper web has been placed when it passes the roll press mechanism or the shoe press mechanism while it is being moved along the wet paper web transfer direction, the moisture from the wet paper web is continuously absorbed by the felt or it is discharged to the outside by passing through the felt; thereby, moisture is squeezed from the wet paper web.

In the shoe press belt, a reinforcing base material is embedded in resin and the resin constitutes an outer circumferential layer contacting the felt and an inner circumferential layer contacting the shoe. The shoe press belt runs repeatedly between the roll and the shoe onto which pressure is applied; therefore, mechanical properties such as wear resistance, crack resistance, flexural fatigue resistance, heat resistance, and the like, are required of the resin of the shoe press belt. To improve these required properties, various shoe press belt resins have been investigated (for example, in JP-A-2012-511611, JP-A-2008-111220, JP-A-2002-146694, and JP-A-2008-536016).

In JP-A-2012-511611, JP-A-2008-111220, and JP-A-2002-146694, belts are investigated in which mechanical properties such as heat resistance, crack resistance, flexural fatigue resistance, wear resistance, and the like, are improved by selecting particular isocyanates and curing agents for the polyurethane. In JP-A-2008-536016, belts are investigated in which mechanical properties such as wear resistance, heat resistance, oxidation resistance, chemical resistance, and the like, are improved by forming a coating layer on the resin surface of the belt with a thermal spray technology.

PRIOR ART DOCUMENTS

Patent Documents

Patent Document 1: JP-A-2012-511611
Patent Document 2: JP-A-2008-111220

Patent Document 3: JP-A-2002-146694
Patent Document 4: JP-A-2008-536016

SUMMARY OF THE INVENTION

Problems to be Solved by the Invention

However, the shoe press belts according to the before-mentioned JP A-2012-511611, JP-A-2008-111220, and JP-A-2002-146694, which are manufactured by individually selecting a resin, are limited in their properties; and in the shoe press belt according to the before-mentioned JP-A-2008-536016, the thermal spray technology involves a high degree of processing difficulty, there is concern about the uniformity of processing, and there is also the risk of resin degradation due to the energy from the thermal spray. Therefore, under these circumstances, in which the operating conditions of papermaking machines become more and more severe together with the increase in the operating speed and the increase in the pressure of the press part, and the like, which are due to the improvement in productivity of paper manufacturing, there is a further demand for an even greater improvement in the mechanical properties of the shoe press belt.

Accordingly, it is the object of the present invention to provide a shoe press belt with excellent mechanical properties, in particular a shoe press belt with excellent wear resistance and chemical resistance, and to provide a method of manufacturing the same.

Means for Solving the Problems of the Invention

The present inventors, as a result of intensive studies in order to achieve the above object, found that excellent durability, in particular excellent wear resistance and chemical resistance, can be achieved by forming a shoe press belt surface by a surface-treated layer, in which part of the resin layer is modified by coating a composition comprising an isocyanate compound onto the semi-finished surface of a shoe press belt and by performing a curing treatment. The present inventors have thus completed the invention.

Accordingly, the present invention relates to the following.

(1) A shoe press belt for use in a papermaking machine, wherein it is constituted by a resin layer and it comprises an outer circumferential layer surface contacting a felt and an inner circumferential layer surface contacting a shoe, and wherein either one or both of the outer circumferential layer surface and the inner circumferential layer surface is/are formed by a surface-treated layer, in which part of the resin layer is modified by coating a composition comprising an isocyanate compound onto either one or both of a semi-finished outer circumferential layer surface and a semi-finished inner circumferential layer surface and by performing a curing treatment.

(2) A shoe press belt according to (1), wherein the isocyanate compound is an isocyanate compound comprising polymeric MDI.

(3) A shoe press belt according to (1) or (2), wherein the coating amount of isocyanate is from 10 $g/m^2$ to 200 $g/m^2$.

(4) A shoe press belt according to (1) to (3), wherein the thickness of the surface-treated layer is from 5 μm to 300 μm.

(5) A shoe press belt according to (1) to (4), wherein the resin layer is a polyurethane resin layer.

(6) A method of manufacturing a shoe press belt for use in a papermaking machine, wherein it comprises a step for forming a resin layer comprising either one or both of a semi-finished outer circumferential layer surface of the side contacting a felt and a semi-finished inner circumferential layer surface of the side contacting a shoe, and a step for forming a surface-treated layer, in which part of the resin layer is modified, by coating a composition comprising an isocyanate compound onto either one or both of the semi-finished outer circumferential layer surface and the semi-finished inner circumferential layer surface and by performing a curing treatment.

Advantages of the Invention

According to the above constitution, it is possible to provide a shoe press belt with excellent mechanical properties, in particular wear resistance and chemical resistance, and a method of manufacturing the same.

MODES FOR CARRYING OUT THE INVENTION

Figure 1:
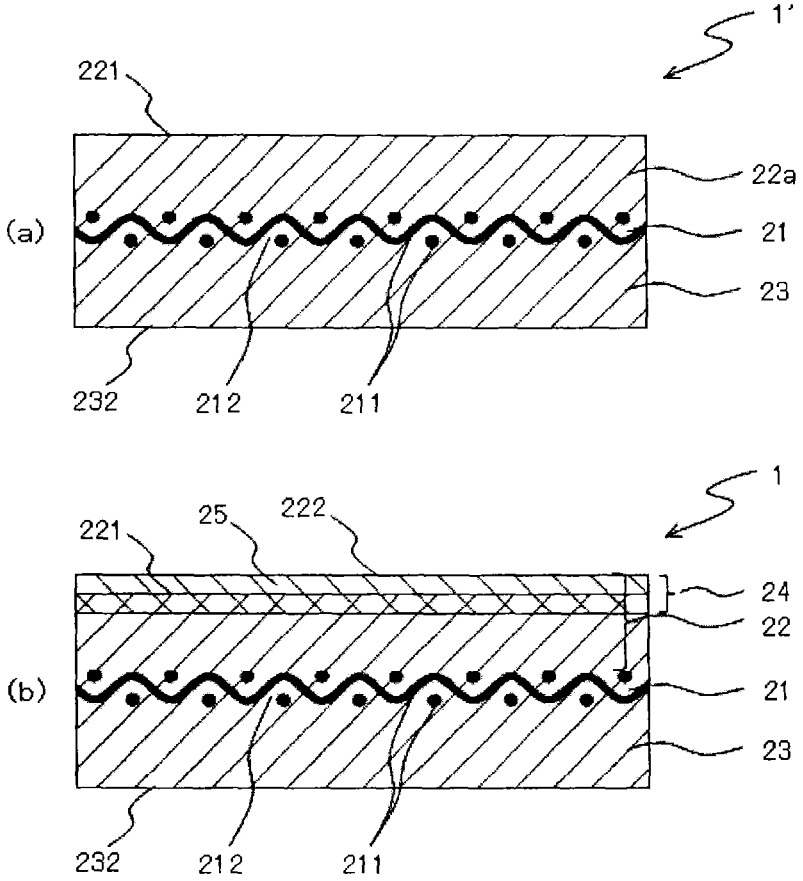
FIG. 1 is a sectional view in the cross-machine direction showing one example of a shoe press belt related to a preferred embodiment of the present invention.

Hereinafter, preferred embodiments of the shoe press belt according to the present invention and a method of manufacturing the same will be explained in detail by referring to the drawings.

First, a shoe press belt according to the present invention will be explained.

FIG. 1 is a sectional view in the cross-machine direction showing one example of a shoe press belt related to a preferred embodiment of the present invention; FIG. 1(*a*) shows a semi-finished shoe press belt 1', and FIG. 1(*b*) shows a completed shoe press belt 1. In the figures, the size of each member is appropriately emphasized to facilitate explanation; this does not represent the actual size or proportion of the different members. Here, the above mentioned cross-machine direction is also referred to as "CMD" and the machine direction is also referred to as "MD".

The shoe press belt 1 shown in FIG. 1 is used in the press part of a papermaking machine to transfer the wet paper web in cooperation with a felt and to squeeze humidity from the wet paper web. The shoe press belt 1 is an endless belt. In other words, the shoe press belt 1 is an annular belt. The shoe press belt 1 is normally arranged with its circumferential direction extended along the machine direction (MD) of a papermaking machine.

The semi-finished shoe press belt 1' shown in FIG. 1(*a*) comprises a reinforcing fibrous base material layer 21, a precursor 22*a* of a $1^{st}$ resin layer (resin layer comprising a semi-finished outer circumferential layer surface 221 of the side contacting the felt) provided on one of the main surfaces on the outer surface side of the reinforcing fibrous base material 21, and a $2^{nd}$ resin layer 23 (resin layer comprising an inner circumferential layer surface 232 contacting the shoe) provided on the other main surface on the inner surface side of the reinforcing fibrous base material layer 21, which is formed by laminating these layers.

The reinforcing fibrous base material layer 21 is constituted by a reinforcing fibrous base material 211 and a resin 212. The resin 212 is present in the reinforcing fibrous base material layer 21 so as to fill the gaps between the fibers in the reinforcing fibrous base material 211. In other words, part of the resin 212 impregnates the reinforcing fibrous base material 211, while the reinforcing fibrous base material 211 is embedded in the resin 212.

The reinforcing fibrous base material 211 is not particularly limited; however, for example, a woven fabric woven by a weaving machine, and the like, from warp and weft yarns is generally used. Moreover, it is also possible to use a grid-like material made by superimposing rows of warp and weft yarns instead of by weaving.

The fineness of the fibers constituting the reinforcing fibrous base material 211 is not particularly limited; however, for example, fibers of 300 to 10,000 dtex, preferably 500 to 6,000 dtex may be used.

Moreover, the fineness of the fibers constituting the reinforcing fibrous base material 211 may be different according to the part in which they are used. For example, the fineness of the warp yarns of the reinforcing base material 211 may be different from that of the weft yarns.

Examples of the material used as reinforcing fibrous base material 211 include one or a combination of two or more of a polyester (polyethylene terephthalate, polybutylene terephthalate, and the like), an aliphatic polyamide (polyamide 6, polyamide 11, polyamide 12, polyamide 612, and the like), an aromatic polyamide (aramide), polyvinylidene fluoride, polypropylene, polyetheretherketone, polytetrafluoroethylene, polyethylene, wool, cotton, metals, or the like.

Examples of the material used as resin 212 include one or a combination of two or more of thermosetting resins such as urethane, epoxy, acrylic, and the like, or thermoplastic resins such as polyamide, polyarylate, polyester, and the like; preferably urethane resins may be used.

The urethane resin used as resin 212 is not particularly limited; however, for example, a urethane resin may be used which is obtained by curing a urethane prepolymer having an isocyanate terminal group, obtained by reacting a polyol with an aromatic or aliphatic polyisocyanate compound, together with a curing agent having an active hydrogen group. It is also possible to use an aqueous urethane resin. In this case, it is also possible to use a cross-linking agent together with the aqueous urethane resin and to cross-link the aqueous urethane resin.

It is also possible to comprise one or a combination of two or more inorganic fillers in the resin 212 such as titanium oxide, kaolin, clay, talc, diatomaceous earth, calcium carbonate, calcium silicate, magnesium silicate, silica, mica, and the like.

Moreover, the constitution and type of the resin 212 in the reinforcing fibrous base material layer 21 may be different in each part in the reinforcing fibrous base material layer 21, or they may be the same.

Examples of resin material constituting the precursor 22*a* of the $1^{st}$ resin layer include one or a combination of two or more of the resin materials that can be used in the above-mentioned reinforcing fibrous base material layer 21. The type and constitution of the resin material constituting the $1^{st}$ resin layer 22 and the resin constituting the reinforcing fibrous base material layer 21 may be the same or different.

In particular, from the viewpoint of mechanical strength, wear resistance and flexibility, a urethane resin is preferred as resin material for constituting the precursor 22*a* of the $1^{st}$ resin layer.

The precursor 22*a* of the $1^{st}$ resin layer may also comprise one or a combination of two or more inorganic fillers in the same way as the reinforcing fibrous base material 21.

Moreover, the type and constitution of the resin material and the inorganic filler in the precursor 22*a* of the $1^{st}$ resin layer may be different in each part of the precursor 22*a* of the $1^{st}$ resin layer, or they may be the same.

Furthermore, it is desirable that the precursor 22*a* of the $1^{st}$ resin layer has the property of not letting water pass through. In other words, it is preferred that the precursor 22*a* of the $1^{st}$ resin layer is water impermeable.

A $2^{nd}$ resin layer (resin layer having the inner circumferential layer surface 232 contacting the shoe) 23 is provided on one of the main surfaces of the reinforcing fibrous base material layer 21 and is primarily made of a resin material.

The $2^{nd}$ resin layer 23 constitutes an inner circumferential layer surface 232 for contacting the shoe on the main surface at the opposite side of the main surface joined to the reinforcing fibrous base material layer 21. During operation, the shoe press belt 1 squeezes humidity from the wet paper web by the pressure applied to the wet paper web, the felt and the shoe press belt when the inner circumferential layer surface 232 contacting the shoe is pressed by the shoe in cooperation with a roll facing the shoe.

Examples of resin material constituting the precursor 23 of the $2^{nd}$ resin layer include one or a combination of two or more of the resin materials that can be used in the above-mentioned reinforcing fibrous base material layer 21. The type and constitution of the resin material constituting the $2^{nd}$ resin layer 23 and the resin constituting the precursor 22*a* of the $1^{st}$ resin layer or the reinforcing fibrous base material layer 21 may be the same or different.

In particular, from the viewpoint of the mechanical properties, wear resistance and flexibility, a urethane resin is preferred as resin material for constituting the $2^{nd}$ resin layer 23.

The $2^{nd}$ resin layer 23 may also comprise one or a combination of two or more inorganic fillers in the same way as the reinforcing fibrous base material 21.

Moreover, the type and constitution of the resin material and the inorganic filler in the $2^{nd}$ resin layer 23 may be different in each part of $2^{nd}$ resin layer 23, or they may be the same.

In the shoe press belt 1 shown in FIG. 1(*b*), a modified surface-treated layer 24, in which part of the precursor 22*a* of the $1^{st}$ resin layer comprising at least the semi-finished outer circumferential layer surface 221 is modified by coating a composition 25 comprising an isocyanate compound onto the semi-finished outer circumferential layer surface 221 of the semi-finished shoe press belt 1' shown in FIG. 1(*a*) and by performing a curing treatment, is formed. In other words, the $1^{st}$ resin layer 22 is formed by the modified surface-treated layer 24 and the precursor 22*a* of the $1^{st}$ resin layer.

The aforementioned curing treatment refers, for example, to air drying and heat treatment and, thereafter, to the inactivation of the residual isocyanate compounds with compounds having a hydroxyl group or an amino group, and to further air drying and heat treatment.

The modified surface-treated layer 24 constitutes an outer circumferential layer surface 222 contacting the felt on the main surface at the opposite side of the boundary surface joined to the precursor 22*a* of the $1^{st}$ resin layer. In other words, the shoe press belt 1 can carry the wet paper web via the felt on the outer circumferential layer surface 222 of the modified surface-treated layer 24, transfer the wet paper web and squeeze humidity from the wet paper web.

In the coating layer 25 of the composition comprising an isocyanate compound, the composition comprising an isocyanate compound is not particularly limited; however, for example, polymeric MDI, monomeric MDI, TDI, PPDI, HDI, IPDI and modified products thereof may be used; preferably polymeric MDI may be used.

Moreover, the compounds having a hydroxyl group or an amino group are not particularly limited; however, for example, methanol, ethanol, propanol, pentafluoropropanol, propanediol, butanediol, water and ammonia water may be used; preferably ethanol, propanol and water may be used.

The composition comprising an isocyanate compound may be coated onto the semi-finished outer circumferential layer surface in an amount of 10 to 200 g/m$^2$, and preferably 30 to 150 g/m$^2$. By doing so, the outer circumferential layer surface of the laminate body 1*a* is modified and the wear resistance can be improved by increasing the hardness and decreasing the resistance to friction.

In this case, the thickness of the modified surface-treated layer may be 5 to 300 preferably it may be 10 to 250 μm; it is also possible to form a shoe press belt having excellent mechanical properties in the thickness direction of the shoe press belt such as, for example, excellent wear resistance of the outer circumferential layer surface part and excellent crack resistance of the inner part.

The dimensions of the above-mentioned shoe press belt 1 are not particularly limited; the dimensions may be suitably set according to the application of the shoe press belt.

For example, the width of the shoe press belt 1 is not particularly limited; however, it can be 700 to 13,500 mm, or preferably 2,500 to 12,500 mm.

Moreover, the length (perimeter) of the shoe press belt 1 is also not particularly limited; however, it can be 150 to 600 cm, or preferably 200 to 500 cm.

Furthermore, the thickness of the shoe press belt 1 is not particularly limited; however, it may, for example, be 1.5 to 7.0 mm, or preferably 2.0 to 6.0 mm.

Moreover, the thickness of the shoe press belt 1 may be different in each part of the shoe press belt, or it may be the same.

The shoe press belt 1 described above can be manufactured according to the manufacturing method of a shoe press belt according to the present invention described hereinafter.

The shoe press belt 1 relating to the embodiment above can improve the wear resistance and chemical resistance.

Figure 2:
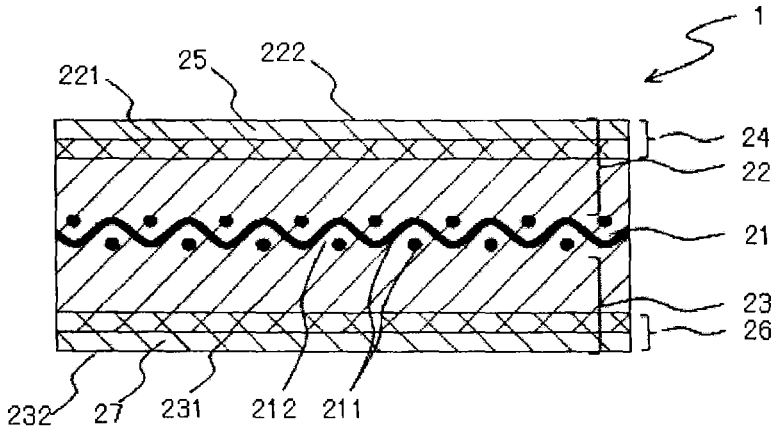
FIG. 2 is a sectional view in the cross-machine direction showing another example of a shoe press belt related to a preferred embodiment of the present invention.

As a modified example of the shoe press belt 1 described above, for example, in the shoe press belt 1 shown in FIG. 2, the $2^{nd}$ resin layer 23 of the shoe press belt 1 shown in FIG. 1(*b*) is used as precursor of the $2^{nd}$ layer; and by using the inner circumferential layer surface 232 contacting the shoe as semi-finished inner circumferential layer surface 231 of the side contacting the shoe, a modified surface-treated layer 26, in which part of the $2^{nd}$ resin layer comprising at least the semi-finished inner circumferential layer surface 231 is modified by coating a composition 27 comprising an isocyanate compound onto this semi-finished inner circumferential layer surface 231 and by performing a curing treatment, is formed. In other words, the $2^{nd}$ resin layer 23 is formed by the modified surface-treated layer 26 and the precursor of the $2^{nd}$ resin layer. In the coating layer 27 of the composition comprising an isocyanate compound, the composition comprising an isocyanate compound is not particularly limited; however, the same composition as in the coating layer 25 of the composition comprising an isocyanate compound may be used.

The modified surface-treated layer 26 constitutes the inner circumferential layer surface 232 contacting the shoe on the main surface at the opposite side of the boundary surface joined to the precursor of the $2^{nd}$ resin layer. During operation, the shoe press belt 1 squeezes humidity from the wet paper web by the pressure applied to the wet paper web, the felt and the shoe press belt when the inner circumferential layer surface 232 contacting the shoe is pressed by the shoe in cooperation with a roll facing the shoe.

Figure 3:
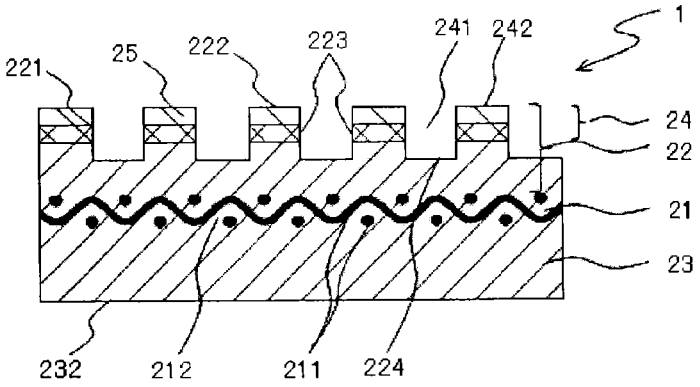
FIG. 3 is a sectional view in the cross-machine direction showing still another example of a shoe press belt related to a preferred embodiment of the present invention.

As another modified example of the shoe press belt 1 described above, for example, in the shoe press belt 1 shown in FIG. 3, drainage grooves 241 are formed in the outer circumferential layer surface 222 of the shoe press belt 1 shown in FIG. 1(*b*), and, in the drainage groove land parts 242, a modified surface-treated layer 24, in which part of the precursor 22*a* of the $1^{st}$ resin layer comprising at least the semi-finished outer circumferential layer surface 221 is modified, is formed.

Figure 4:
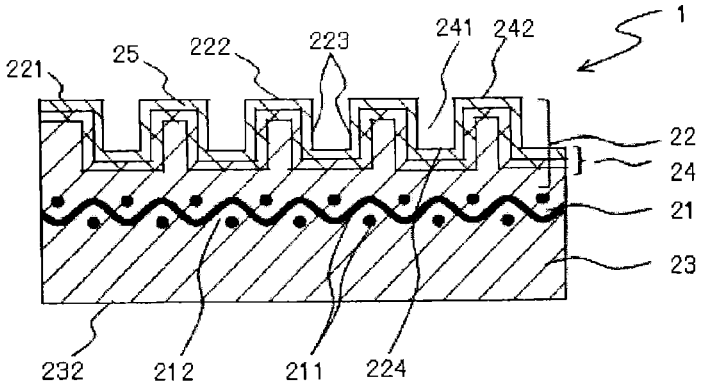
FIG. 4 is a sectional view in the cross-machine direction showing yet another example of a shoe press belt related to a preferred embodiment of the present invention.

As yet another modified example of the shoe press belt 1 described above, for example, in the shoe press belt 1 shown in FIG. 4, a modified surface-treated layer 24 comprising at least the semi-finished outer circumferential layer surface 221, the groove walls 223 and the groove bottoms 224, in which part of the precursor 23*a* of the $2^{nd}$ resin layer is modified by coating a composition comprising an isocyanate compound onto the semi-finished outer circumferential layer surface 221, the groove walls 223 and the groove bottoms 224 of the shoe press belt 1 shown in FIG. 3 and by performing a curing treatment, is formed.

The shoe press belts 1 illustrated in FIGS. 3 and 4 can squeeze more humidity from the wet paper web because of the drainage grooves. The configuration of the drainage grooves in not particularly limited; however, a plurality of parallel and continuous grooves is generally formed in the machine direction of the shoe press belt. For example, it is possible to set the groove width at 0.5 to 2.0 mm, the groove depth at 0.4 to 2.0 mm, and the number of grooves at 5 to 20 grooves per inch. Moreover, the sectional shape of the grooves may be suitably set to a rectangular, trapezoidal or U-shape, or the parts connecting the land parts, the bottom parts and the groove walls may be rounded, and the like.

Furthermore, the groove width, the groove depth, the number of grooves and the sectional shape of these drainage grooves may all be the same, or different configurations may be combined. Further, these drainage grooves may also be formed as non-continuous grooves; a plurality of parallel grooves may also be formed in the cross-machine direction.

The shoe press belts 1 relating to the embodiments illustrated in FIGS. 2 to 4 above can improve the wear resistance and the chemical resistance in the modified surface-treated layer in the same way as the shoe press belt 1 illustrated in FIG. 1.

Moreover, in the embodiments described above, it has been explained that the modified surface-treated layer 24 and the modified surface-treated layer 26 are provided on the entire outer circumferential surface of the $1^{st}$ resin layer 22 and the $2^{nd}$ resin layer 23; however, the present invention is not limited thereto, it is also possible to provide the above described modified surface-treated layer only in the regions subjected to the pressure by the shoe and the roll.

Furthermore, it is also possible to suitably provide the shoe press belt with tabs, and the like, matching the constitution of the papermaking machine used.

Next, preferred embodiments of methods for manufacturing a shoe press belt according to the present invention will be explained. FIGS. 5 to 10 are schematic views for explaining preferred embodiments of methods for manufacturing a shoe press belt according to the present invention.

The method of manufacturing a shoe press belt relating to an embodiment of the present invention is a method of manufacturing a shoe press belt for carrying a wet paper web via a felt, transporting the wet paper web, and squeezing humidity from the wet paper web; wherein it comprises a step for forming a resin layer having either one or both of a semi-finished outer circumferential layer surface and a semi-finished inner circumferential layer surface, and a step for forming a surface-treated layer, in which part of the resin layer is modified, by coating a composition comprising an isocyanate compound onto either one or both of a semi-finished outer circumferential layer surface and a semi-finished inner circumferential layer surface and by performing a curing treatment.

As method of manufacturing a shoe press belt relating to the first embodiment of the present invention, a method of manufacturing a shoe press belt will be explained which comprises a step for forming a resin layer having a semi-finished outer circumferential layer surface and a step for forming a surface-treated layer, in which part of the resin layer is modified, by coating a composition comprising an isocyanate compound onto the semi-finished outer circumferential layer surface and by performing a curing treatment.

Firstly, a resin layer is formed in the step for forming a resin layer having a semi-finished outer circumferential layer surface. More specifically, in this step are formed, the reinforcing fibrous base material layer 21, in which the annular and belt-shaped reinforcing fibrous base material 211 is embedded in a resin material, and a laminate body 1'*a*, in which the precursor 22*a* of the $1^{st}$ resin layer and the $2^{nd}$ resin layer 23 are laminated as resin layer on either side of said reinforcing fibrous base material layer.

This laminate body 1'*a* may be formed by any method. In the present embodiment, the $2^{nd}$ resin layer 23 is formed; the reinforcing fibrous base material 211 is arranged on one side of the $2^{nd}$ resin layer 23; a resin material is coated onto the reinforcing base material 211, impregnating and penetrating the same; a laminate body is formed in which the reinforcing fibrous base material layer 21 and the $2^{nd}$ resin layer 23 are integrated; next, the precursor 22*a* of the $1^{st}$ resin layer is formed on the surface of the reinforcing fibrous base material layer 21 which faces the joining surface of the reinforcing fibrous base material layer 21 and the $2^{nd}$ resin layer 23.

Figure 5:
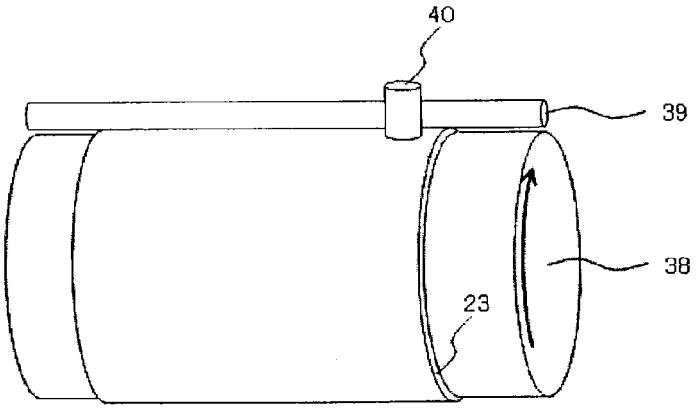
FIG. 5 is a schematic view for explaining one part of a preferred embodiment of the method of manufacturing a shoe press belt according to the present invention.

Specifically, for example, first, as shown in FIG. 5, the $2^{nd}$ resin layer 23 is formed by coating a resin material onto the surface of a mandrel 38, onto which a releasing agent has been coated, while the mandrel 38 is being rotated so as to form a thickness of 0.8 to 3.5 mm, and by curing this coated layer of resin material for 0.5 to 1 hour at a temperature of 40 to 140° C.

Figure 6:
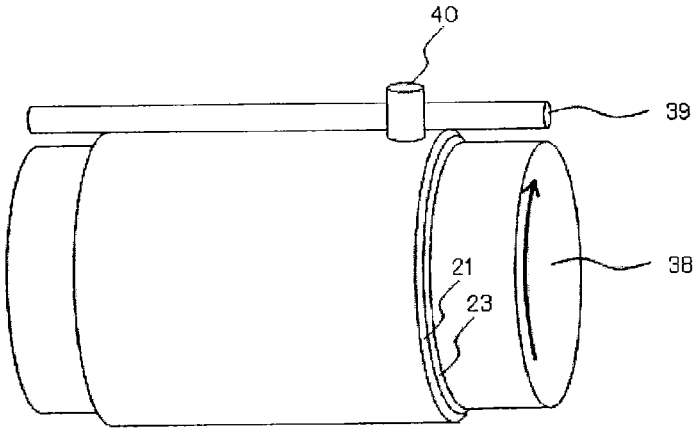
FIG. 6 is a schematic view for explaining one part of a preferred embodiment of the method of manufacturing a shoe press belt according to the present invention.

Then, a reinforcing fibrous base material (not shown in the drawings) is arranged on top thereof; 0.5 to 2.0 mm of a resin material for forming the reinforcing fibrous base material layer 21 is coated while the mandrel 38 is being rotated as shown in FIG. 6; while the reinforcing fibrous base material is impregnated and penetrated by the resin material, it is bonded with the $2^{nd}$ resin layer 23; and a laminate body is formed in which the reinforcing fibrous base material layer 21 and the $2^{nd}$ resin layer 23 are integrated.

Figure 7:
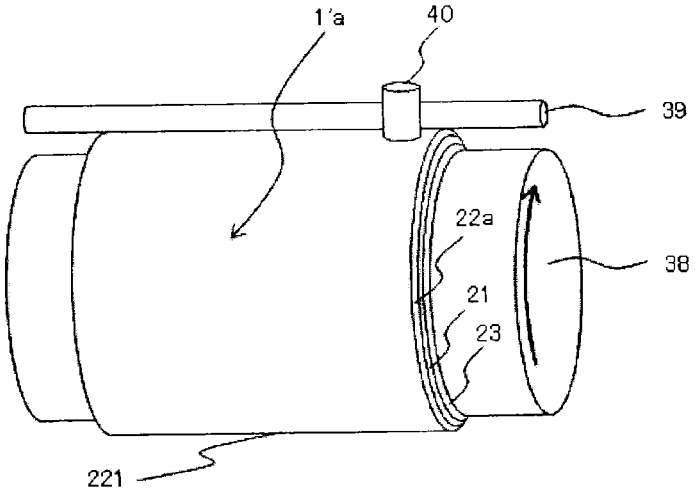
FIG. 7 is a schematic view for explaining one part of a preferred embodiment of the method of manufacturing a shoe press belt according to the present invention.

Thereafter, a resin material for forming the precursor 22*a* of the $1^{st}$ resin layer is coated so as to form a thickness of 1.5 to 4 mm on the surface of the reinforcing fibrous base material layer 21, impregnating said reinforcing fibrous base material layer, while the mandrel 38 is being rotated as shown in FIG. 7; the laminate body 1'*a* is formed by curing this coated layer of resin material for 2 to 20 hours at a temperature of 70 to 140° C.

Any method may be used for coating the resin material. In the present embodiment, the coating is performed by applying the resin material onto each layer by ejecting it from the injection molding nozzle 40 while the mandrel 38 is being rotated, and at the same time, the resin material is coated uniformly onto each layer using a coating bar 39.

The heating method, too, is not particularly limited; however, for example, a heating with a far infrared heater can be used.

Moreover, the resin material may also be applied as a mixture with the above-mentioned inorganic fillers. Furthermore, the resin materials and fillers for forming each part of each layer may all be of the same type and constitution, or they may be different.

Next, the surface-treated layer in which part of the resin layer has been modified is formed.

Figure 8:
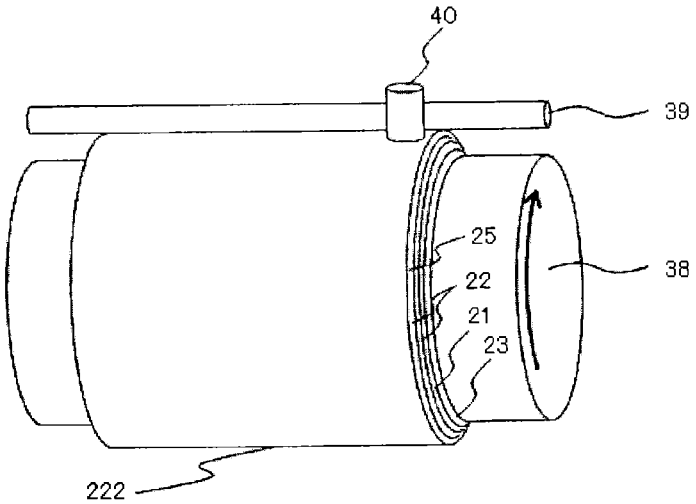
FIG. 8 is a schematic view for explaining one part of a preferred embodiment of the method of manufacturing a shoe press belt according to the present invention.

Specifically, the composition comprising an isocyanate compound is coated on the surface of the precursor 22*a* of the $1^{st}$ resin layer of the laminate body 1'*a* shown in FIG. 7, in other words, the semi-finished outer circumferential layer surface 221 (FIG. 8). The coating of the composition comprising an isocyanate compound is not particularly limited; the coating may be performed by using any method.

Moreover, in order to uniformly coat the composition comprising an isocyanate compound onto the semi-finished outer circumferential layer surface 221, it is also possible to use a material absorbing liquid, such as for example a spongy material, on the surface of the coater bar 39.

In the coating layer 25 of the composition comprising an isocyanate compound, the composition comprising an isocyanate compound is not particularly limited; however, for example, polymeric MDI, monomeric MDI, TDI, PPDI, HDI, IPDI and modified products thereof may be used; preferably polymeric MDI may be used.

Next, the laminate body in which the composition comprising an isocyanate compound has been coated is cured. By doing so, the $1^{st}$ resin layer 22 is formed by the precursor 22*a* of the $1^{st}$ resin layer and the modified surface-treated layer 24, in which part of the precursor 22*a* of the $1^{st}$ resin layer is modified and which comprises the semi-finished outer circumferential layer surface 221. In other words, the laminate body 1*a* can be obtained in which the $1^{st}$ resin layer 22, the reinforcing fibrous base material layer 21 and the $2^{nd}$ resin layer 23 are laminated in this order from the outer surface. The curing treatment of the resin material is not particularly limited; however, in the present embodiment, after air drying and heat treatment are performed, the residual isocyanate compounds are inactivated by coating compounds having a hydroxyl group or an amino group, and by further air drying and heat treatment.

Figure 9:
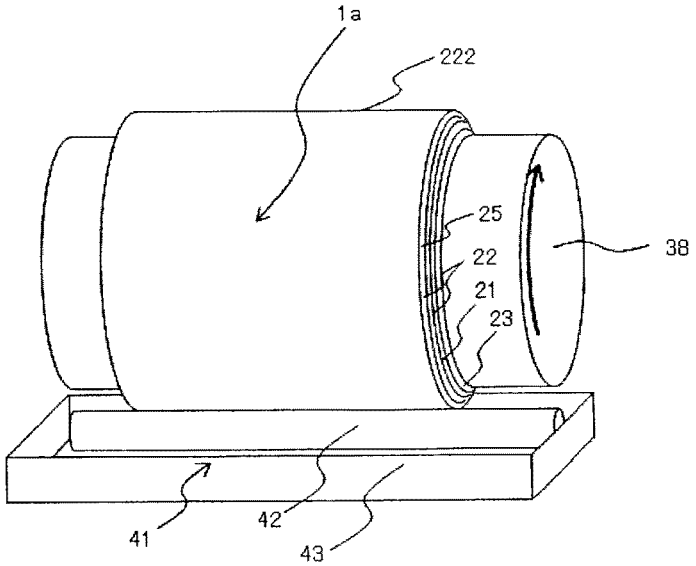
FIG. 9 is a schematic view for explaining one part of a preferred embodiment of the method of manufacturing a shoe press belt according to the present invention.

The method of coating the compounds having a hydroxyl group or an amino group is not particularly limited; however, in the present embodiment, the coating is performed by a coating device 41 while the laminate body 1*a* is being rotated by the mandrel 38, as shown in FIG. 9. The coating device 41 is provided with a coating roll 42 and a bath 43; the compounds having a hydroxyl group or an amino group, which are kept in the bath 43, can be coated by being transferred to the roll 42 and from the roll 42 to the outer circumferential layer surface 222.

Moreover, in order to uniformly coat the compounds having a hydroxyl group or an amino group onto the outer circumferential layer surface 222, it is also possible to use a material absorbing liquid, such as for example a spongy material, on the surface of the coating roll 42.

The composition comprising an isocyanate compound can be coated onto the semi-finished outer circumferential layer surface at a rate of 10 to 200 $g/m^2$, or preferably 30 to 150 $g/m^2$. By doing so, the outer circumferential layer surface of the laminate body 1*a* is modified and the wear resistance can be improved by increasing the hardness and decreasing the resistance to friction.

In this case, the thickness of the modified surface-treated layer may be 5 to 300 μm, preferably it may be 10 to 250 μm; it is also possible to form a shoe press belt having excellent mechanical properties in the thickness direction of the shoe press belt such as, for example, excellent wear resistance of the outer circumferential layer surface part and excellent crack resistance of the inner part.

Above, as method of manufacturing a shoe press belt relating to the first embodiment of the present invention, a method of manufacturing has been explained which comprises a step for forming a resin layer having a semi-finished outer circumferential layer surface and a step for forming a surface-treated layer, in which part of the resin layer is modified, by coating a composition comprising an isocyanate compound onto the semi-finished outer circumferential layer surface and by performing a curing treatment.

Further, as method of manufacturing a shoe press belt relating to the second embodiment of the present invention, a method of manufacturing will be explained which comprises a step for forming a resin layer having a semi-finished inner circumferential layer and a step for forming a surface-treated layer, in which part of the resin layer is modified, by coating a composition comprising an isocyanate compound onto the semi-finished inner circumferential layer surface and by performing a curing treatment.

Firstly, a resin layer is formed in the step for forming a resin layer having a semi-finished inner circumferential layer surface. More specifically, in this step are formed, the reinforcing fibrous base material layer, in which the annular and belt-shaped reinforcing fibrous base material is embedded in a resin material, and a laminate body, in which the $1^{st}$ resin layer and the precursor of the $2^{nd}$ resin layer are laminated as resin layer on either side of said reinforcing fibrous base material layer.

Basically, in the same way as in the method of manufacturing a shoe press belt relating to the first embodiment, a laminate body is obtained by forming the outer circumferential layer surface by using the precursor of the $1^{st}$ resin layer of the shoe press belt relating to the first embodiment as $1^{st}$ resin layer, and by forming the semi-finished inner circumferential layer surface by using the $2^{nd}$ resin layer as the precursor of the $2^{nd}$ resin layer.

Next, the surface-treated layer in which part of the resin layer has been modified is formed.

The laminate body obtained is taken from the mandrel and is then installed and stretched on two rolls arranged in parallel so that the semi-finished inner circumferential layer surface is in contact with the roll surface. Next, by coating the composition comprising an isocyanate compound by a coating device onto the semi-finished inner circumferential layer surface and by curing treatment, the $2^{nd}$ resin layer is formed by the precursor of the $2^{nd}$ resin layer and the modified surface-treated layer, in which part of the precursor of the $2^{nd}$ resin layer comprising the semi-finished inner circumferential layer surface is modified. In other words, a shoe press belt can be obtained in which the $1^{st}$ resin layer, the reinforcing fibrous base material layer and the $2^{nd}$ resin layer are laminated in this order from the outer surface.

The composition comprising an isocyanate compound and the coating and curing thereof are not particularly limited. For example, the methods for coating the composition comprising an isocyanate compound and for curing described for the method of manufacturing a shoe press belt relating to the first embodiment may be used.

Above, as method of manufacturing a shoe press belt relating to the second embodiment of the present invention, a method of manufacturing has been explained which comprises a step for forming a resin layer having a semi-finished inner circumferential layer and a step for forming a surface-treated layer, in which part of the resin layer is modified, by coating a composition comprising an isocyanate compound onto the semi-finished inner circumferential layer surface and by performing a curing treatment.

The above-mentioned method of manufacturing a shoe press belt relating to the first and second embodiments of the present invention has been explained regarding the method of manufacturing a shoe press belt having a modified surface-treated layer on either the outer circumferential layer surface or the inner circumferential layer surface; however, it is also possible to combine both and to use a method of manufacturing a shoe press belt having a modified surface-treated layer on both the outer circumferential layer surface and the inner circumferential layer surface.

Figure 10:
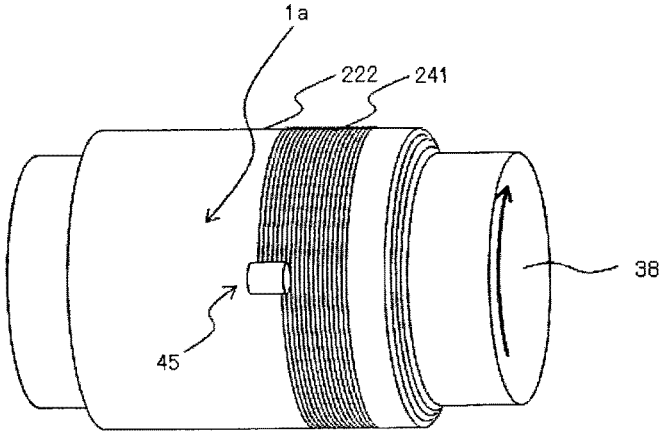
FIG. 10 is a schematic view for explaining one part of a preferred embodiment of the method of manufacturing a shoe press belt according to the present invention.

Moreover, as shown in FIG. 10, it is also possible to form drainage grooves 241 in the outer circumferential layer surface 222 of the shoe press belt by using a groove cutting device 45. Furthermore, it is possible to form the drainage grooves 241 either after or before forming the modified surface-treated layer 24.

In case the drainage grooves 241 are formed before the modified surface-treated layer 24 is formed, it is possible to coat the composition comprising an isocyanate compound only on the semi-finished outer circumferential layer surface 221 (the surface of the groove land parts), or to coat said composition on the semi-finished outer circumferential layer surface 221 (the surface of the groove land parts), the groove walls 223 and the groove bottoms 224.

Moreover, in the methods of manufacturing a shoe press belt in the above-described embodiments, a mandrel (one roll) or two rolls arranged in parallel can be used at will. Furthermore, by inverting the working processes in each step, the order of forming the different resin layers and the modified surface-treated layer may be selected at will.

Above, the present invention has been explained in detail based on the preferred embodiments; however, the present invention is not limited thereto; as long as the same function is obtained, each constitution may be freely substituted or features may be freely added.

EXAMPLES

Hereinafter, the present invention will be explained in even greater detail by examples; however, the present invention is not limited by these examples.

1. Manufacturing of a Shoe Press Belt

The shoe press belts of Examples 1 to 4 and Comparative Examples 1 to 4 were manufactured according to the following method.

(1) Step for Forming a Resin Layer Having a Semi-Finished Outer Circumferential Layer The $2^{nd}$ resin layer was formed by coating a resin material to a thickness of 1.4 mm onto the surface of a mandrel with a diameter of 1,500 mm, which can be rotated by a suitable driving means, while the mandrel was being rotated, by an injection molding nozzle which can move in parallel to the rotational axis of the mandrel, and by performing a curing treatment (FIG. 5). During the curing treatment, the resin layer was allowed to remain at room temperature for 10 minutes while the mandrel kept on rotating; heat curing was further performed for 0.5 hours at 127° C. by a heating device attached to the mandrel.

Next, a grid-like material (warp yarn mesh:1 yarn/cm, weft yarn mesh: 4 yarns/cm) made from multifilament twisted yarns of 5000 dtex polyethylene terephthalate fibers as weft yarns and multifilament yarns of 550 dtex polyethylene terephthalate fibers as warp yarns, wherein the warp yarns are sandwiched by the weft yarns and the intersecting parts of the weft and warp yarns are joined by a urethane resin adhesive, was arranged on the outer circumferential surface of the $2^{nd}$ resin layer without gaps so that the weft yarn is aligned along the axis direction of the mandrel. Then, a wound-yarn layer was formed by spirally winding a multifilament yarn of 6700 dtex polyethylene terephthalate fibers at a pitch of 30 yarns/5 cm on the outer circumference of this grid-like material; the reinforcing fibrous base material was formed by the grid-like material and the wound-yarn layer. Thereafter, a resin material was coated, which is identical to the resin material of the $2^{nd}$ resin layer, so as to close the gaps of the reinforcing fibrous base material; a laminate body was formed in which the reinforcing fibrous base material layer and the $2^{nd}$ resin layer are integrated (FIG. 6).

Next, a laminate body was formed, in which the precursor of the $1^{st}$ resin layer, the reinforcing fibrous base material layer and the $2^{nd}$ resin layer are integrated, by coating a resin material, which is identical to the resin material of the reinforcing fibrous base material layer and the $2^{nd}$ resin layer, from above the reinforcing fibrous base material layer by an injection molding nozzle, which can move in parallel to the rotational axis of the mandrel to, a thickness of about 2.5 mm, while the mandrel was being rotated, by impregnating the reinforcing base material with the resin material, and by performing a curing treatment (FIG. 7). During the curing treatment, the resin layer was allowed to remain at room temperature for 40 minutes while the mandrel kept on rotating; heat curing was further performed for 16 hours at 127° C. by a heating device attached to the mandrel.

Thereafter, the semi-finished product of a shoe press belt was obtained by polishing the outer circumferential layer surface of the precursor of the 1st resin layer so as to obtain a total thickness of 5.2 mm.

(2) Step for Forming a Surface-Treated Layer in which Part of the 1st Resin Layer is Modified A composition comprising an isocyanate compound was coated onto the semi-finished surface of the precursor of the 1st resin layer obtained, in other words, on the semi-finished outer circumferential layer surface, and a heat treatment was performed for 6 hours at 110° C. (FIG. 8). Thereafter, propanol was coated by using a sponge for coating (FIG. 9). After coating, air drying was performed for 6 hours at room temperature and heat treatment was performed for 2.5 hours at 60° C.

(3) Step for Forming Drainage Grooves in the Outer Circumferential Layer Surface Next, a shoe press belt was obtained in which a plurality of drainage grooves of the MD direction (groove width: 0.8 mm, groove depth: 0.8 mm, pitch width: 2.54 mm) are formed by a groove cutting device on the outer circumferential layer surface (FIG. 10).

By passing through the above steps, shoe press belts having a surface-treated layer, in which the outer circumferential layer surface is modified, were obtained for the Examples. Moreover, the shoe press belts for the Comparative Examples passed through the (1) step for forming a resin layer having a semi-finished outer circumferential layer and the (3) step for forming drainage grooves in the outer circumferential layer surface, thereby having no surface-treated layer, in which the outer circumferential layer surface was modified.

The resin materials used in the resin layers of the shoe press belts, the resin materials of the composition having an isocyanate compound and the coating amount are shown in Table 1 for each Example. The Comparative Examples used the resin materials and coating amounts of the Examples, but they did not have a modified surface-treated layer in the 1st resin layer.

2. Evaluation of the Wear Resistance

Figure 11:
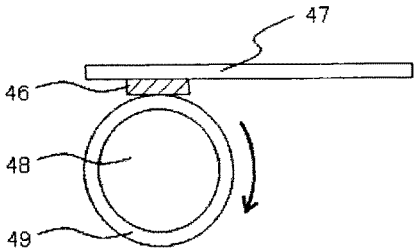
FIG. 11 is a schematic diagram showing an evaluation device for evaluating the wear resistance of a shoe press belt according to the present invention.

For evaluating the wear resistance, the evaluation device shown in FIG. 11 was used; a sample of a shoe press belt 46 was installed below a press board 47, on the lower surface thereof (the surface to be measured) a friction block 49 was pressed against the outer circumference by pressing a rotating roll 48 while it was being rotated. In this case, the pressure from the rotating roll was 6.6 kg/cm, the rotational speed was 100 m/min., the roll was rotated for 45 seconds. The reduction in thickness (wear amount) of the belt sample was measured after rotation.

3. Evaluation of the Chemical Resistance

A sample of 1 cm in the machine direction and 1 cm in the cross-machine direction was cut to 1 mm in the depth direction from the outer circumferential layer surface of the shoe press belt (in the shoe press belt before drainage grooves are formed in the outer circumferential surface). The cut resin sample was immersed in 50 cc of dimethylformamide (DMF) for two day under an atmosphere at 20° C. Immediately after immersion, the dimensions were measured and the rate of change of the volume was determined according to the following formula:

$$\text{Rate of change of the volume (\%)} = \text{volume (cm}^3\text{) after immersion in DMF/volume (cm}^3\text{) before immersion} \times 100 \quad \text{[Formula 1]}$$

The results of the evaluation of the wear resistance and the chemical resistance are shown in Table 2. The evaluation results are expressed as relative value of the respective Comparative Example.

TABLE 2

| | Examples | | | | Comparative Examples | | |
|---|---|---|---|---|---|---|---|
| | 1 | 2 | 3 | 4 | 1 | 2 (3) | 4 |
| Wear resistance evaluation Relative value (%) | 24.8 | 24.9 | 25.1 | 67.3 | 100 | 100 | 100 |
| Chemical resistance evaluation Relative value (%) | 31.1 | 54.9 | 36.3 | 60.8 | 100 | 100 | 100 |

As shown in Table 2, it was found that the shoe press belts of Examples 1 to 4 have improved wear resistance and chemical resistance due to the modified treated layer formed on the outer circumferential layer surface.

TABLE 1

| | | Examples | | | | Comparative Examples | | |
|---|---|---|---|---|---|---|---|---|
| | | 1 | 2 | 3 | 4 | 1 | 2 (3) | 4 |
| Resin material of the resin layer | | TDI polyurethane | TDI polyurethane | TDI polyurethane | PPDI polyurethane | TDI polyurethane | TDI polyurethane | PPDI polyurethane |
| Resin hardness (° JIS-A) of outer circumferential layer surface | Before surface treatment | 91.5 | 93.9 | 93.9 | 97.0 | 91.5 | 93.9 | 97.0 |
| | After surface treatment | 93.9 | 94.0 | 95.2 | 98.0 | — | — | — |
| Resin of the composition comprising an isocyanate compound | | Polymeric MDI | Polymeric MDI | Polymeric MDI | Polymeric MDI | — | — | — |
| Coating amount of the composition comprising an isocyanate compound (g/m$^2$) | | 93 | 35 | 98 | 146 | — | — | — |
| Thickness of the modified surface-treated layer (μm) | | 176 | 18 | 185 | 203 | | | |

EXPLANATION OF THE REFERENCE NUMERALS

1: Shoe press belt (complete), 1': Shoe press belt (semi-finished), la: Laminate body (after the formation of the modified surface-treated layer), 1'*a*: Laminate body (before the formation of the modified surface-treated layer), 21: Reinforcing fibrous base material layer, 211: Reinforcing fibrous base material, 212: Resin, 22: $1^{st}$ resin layer, 22*a*: Precursor of the $1^{st}$ resin layer, 221: Semi-finished outer circumferential layer surface, 222: Outer circumferential layer surface, 223: Groove wall, 224 Groove bottom, 23: $2^{nd}$ resin layer, 231: Semi-finished inner circumferential surface, 232: Inner circumferential layer surface, 24: Modified surface-treated layer, 241: Drainage groove, 242: Drainage groove land part, 25: Coating layer of the composition comprising an isocyanate compound, 26: Modified surface-treated layer, 27: Coating layer of the composition comprising isocyanate compounds, 38: Mandrel, 39: Coater bar, 40: Injection molding nozzle, 41: Coating device, 42: Coating roll, 43: Bath, 45: Groove cutting device, 46: Shoe press belt sample, 47: Press board, 48: Rotational roll, 49: Friction block

The invention claimed is:

1. A shoe press belt for use in a papermaking machine, the belt comprising:

a resin layer comprising an outer circumferential layer surface and an inner circumferential layer surface, and wherein part of the resin layer on either one or both sides of the outer circumferential layer surface and the inner circumferential layer surface is a surface-treated layer, which is formed by coating a composition comprising an isocyanate compound onto either one or both surfaces of the resin layer and by performing a curing treatment to modify the part of the resin layer, and wherein the outer circumferential layer surface includes a plurality of drainage grooves such that groove walls and groove bottoms are formed, and the groove walls and the groove bottoms are coated by the composition, wherein the resin layer is a polyurethane resin layer, and the isocyanate compound comprises polymeric diphenylmethane diisocyanate (MDI), wherein the coating amount of the composition comprising the isocyanate compound is from 10 $g/m^2$ to 200 $g/m^2$, wherein a thickness of the surface-treated layer is from 5 μm to 300 μm, wherein the hardness of the surface-treated layer is increased by coating the composition comprising the isocyanate compound, and wherein the curing treatment is performed to modify the part of the resin layer from either one or both surfaces thereof toward a depth direction.

* * * * *